US007735186B1

(12) United States Patent
Vogel

(10) Patent No.: US 7,735,186 B1
(45) Date of Patent: Jun. 15, 2010

(54) SURFACE CLEANING VEHICLE

(76) Inventor: Hans E. Vogel, 560 E. City Cr., Unit E, Palmer, AK (US) 99645

( * ) Notice: Subject to any disclaimer, the term of this patent is extended or adjusted under 35 U.S.C. 154(b) by 722 days.

(21) Appl. No.: 11/301,462

(22) Filed: Dec. 12, 2005

Related U.S. Application Data

(60) Provisional application No. 60/635,267, filed on Dec. 10, 2004.

(51) Int. Cl.
*A47L 7/00* (2006.01)

(52) U.S. Cl. ..... 15/320; 15/340.1

(58) Field of Classification Search ..... 15/320, 15/340.1, 300.1
See application file for complete search history.

(56) References Cited

U.S. PATENT DOCUMENTS

| | | | | | |
|---|---|---|---|---|---|
| 3,870,489 | A * | 3/1975 | Shaddock | 55/314 |
| 4,586,208 | A * | 5/1986 | Trevarthen | 8/158 |
| 4,696,075 | A * | 9/1987 | Grave | 15/321 |
| 5,287,589 | A * | 2/1994 | Hughes | 15/321 |
| 5,404,613 | A * | 4/1995 | Whyte | 15/320 |
| 5,407,584 | A * | 4/1995 | Broussard, Sr. | 210/703 |
| 5,444,892 | A * | 8/1995 | Ris et al. | 15/304 |
| 5,947,300 | A * | 9/1999 | Lange | 209/726 |
| 6,381,801 | B1 * | 5/2002 | Clemons, Sr. | 15/320 |
| 6,481,448 | B2 * | 11/2002 | Mathieu | 134/109 |
| 6,675,437 | B1 * | 1/2004 | York | 15/321 |
| 6,896,742 | B2 * | 5/2005 | Geyer et al. | 134/21 |
| RE39,422 | E * | 12/2006 | Clemons | 15/320 |
| 2002/0002985 | A1 * | 1/2002 | Mathieu | 134/10 |
| 2003/0037805 | A1 * | 2/2003 | Mathieu | 134/10 |
| 2005/0210623 | A1 * | 9/2005 | Buckner | 15/340.1 |

* cited by examiner

*Primary Examiner*—David B Thomas
(74) *Attorney, Agent, or Firm*—Deborah A. Peacock; Justin R. Jackson; Peacock Myers, P.C.

(57) ABSTRACT

A method and apparatus for cleaning large surface areas. The method and vehicle clean large surface areas such as streets, runways, aircraft carrier decks, and the like, wherein a substantial portion of the soiled water is recaptured, processed, and reused.

35 Claims, 15 Drawing Sheets

SURFACE CLEANING VEHICLE

CROSS-REFERENCE TO RELATED APPLICATIONS

This application claims priority to and the benefit of the filing of U.S. Provisional Patent Application Ser. No. 60/635,267, entitled "Mobile Cleaning, Reclamation and Recycling Vehicle", filed on Dec. 10, 2004, and the specification thereof is incorporated herein by reference.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Contract No. N00014-02-M-0176 awarded by the U.S. Navy.

BACKGROUND OF THE INVENTION

1. Field of the Invention (Technical Field)

The present invention relates to a cleaning method and apparatus. Particularly, the present invention relates to a method and apparatus for cleaning a large surface area. No soaps or solvents are required, and a substantial portion of cleaning water is recovered for reuse.

2. Description of Related Art

Note that the following discussion refers to a publication that due to recent publication date is possibly not to be considered as prior art vis-a-vis the present invention. Discussion of such publication herein is given for more complete background and is not to be construed as an admission that such publication is prior art for patentability determination purposes.

Since the U.S. Navy first introduced the aircraft carrier, keeping the large deck area clean has proven challenging and costly. This is particularly true since the various aircraft which use the deck often leak oils, greases, and other fluids onto the deck. This impairs the ability of aircraft to gain proper traction which results in pilots struggling to maintain full control of their aircraft. In response, the Navy has expended vast sums of money and manpower to manually apply soap and water to the deck and then scrub the entire surface with brushes. Since the surface area of the decks of aircraft carriers are very large, substantial amounts of soap are required to clean them. The cost of soap for one aircraft carrier alone can amount to nearly $70,000 per deployment. Further, manually soaping and scrubbing the entire deck of an aircraft carrier impedes the use of the deck by aircraft during the extensive cleaning process, thus resulting in down time for the ship.

While various vehicles are known to be of use for cleaning surfaces, none of the known systems enable a user to continuously recycle virtually all the water used by using solid-liquid and liquid-liquid cyclones as well as strainers and/or a self-flushing filter. U.S. Pat. No. 6,381,801, to Clemons, Sr. describes one such system. The disclosure of that patent, however, is directed to a very large vehicle which relies primarily on filters to achieve water recycling. Those skilled in the art will readily recognize that the Clemons, Sr. design is highly susceptible to filter clogging. A system which relies primarily on filters for the purpose of continuous water recycling has the serious drawback of repeatedly requiring a user to remove and clean filters after operation of the vehicle for only short periods of time. As such, the vehicle of Clemons, Sr. not only is inefficient and maintenance prone, but is also a very large and bulky vehicle.

Other cleaning vehicles known in the art are typically very large and must carry two water tanks onboard to sustain operation. A first tank is generally a clean water tank and a second is typically a recovery tank.

None of the known prior art vehicles provide a soapless/brushless solution for cleaning large surface areas. Because the present invention can recycle the water that is used, discharge regulations which exist for certain areas are more easily complied with.

There is thus a present need for a mobile cleaning, reclamation, and recycling apparatus that enables a user to recycle virtually all of the water used through the efficient use of cyclones within a compact and mobile unit.

BRIEF SUMMARY OF THE INVENTION

An advantage of the present invention is that large surfaces are cleaned quickly and efficiently. The present invention relates to cleaning large surface areas by recycling a cleaning fluid such as water.

The present invention is directed to a mobile cleaning apparatus for cleaning large surface areas. The apparatus comprises one or more wheels, a clean water supply tank, a high pressure pump, an air blower, and a water processing unit. The water processing unit can have a recovery tank and at least one solid-liquid cyclone. In addition, the water processing unit can also have a liquid-liquid cyclone and/or a filter, which can be a self-flushing filter. The mobile cleaning apparatus can include one or more rotating high-pressure nozzles, an oil decant tank, one or more circulating pumps, and/or one or more power supplies.

The solid-liquid cyclone can have a plurality of solid-liquid cyclones and an output of one solid-liquid cyclone can be connected in series or in parallel with one or more solid-liquid cyclones. Thus, an output of a one solid-liquid cyclone can be connected to an input of another solid-liquid cyclone in a series configuration or the plurality of solid-liquid cyclones can be connected in a manifold type configuration such that they are in parallel with one another.

If one or more solid-liquid cyclones are used in conjunction with one or more liquid-liquid cyclones, the one or more solid-liquid cyclones can be connected in series with one or more liquid-liquid cyclones. Optionally, one or more solid-liquid cyclones can be connected in parallel with one or more liquid-liquid cyclones.

The present invention also relates to a mobile cleaning apparatus for cleaning large surface areas. This embodiment comprises one or more wheels, a clean water supply tank, a high pressure pump, an air blower, and a water processing unit having a liquid-liquid cyclone and a solid-liquid cyclone. The water processing unit can also have a filter and/or one or more circulating pumps.

The present invention also relates to a method for cleaning large surface areas. The method comprises generating a pressurized flow of water, emitting a spray of pressurized water from one or more rotatably attached nozzles, creating a flow of air around an area of the surface to be cleaned such that at least a substantial amount of the soiled water resulting from the cleaning process is recovered, passing the soiled water through a solid-liquid cyclone, capturing the liquid constituents of the soiled water from the solid-liquid cyclone, and recycling the liquid constituents of the soiled water such that they are again pressurized for re-use in the cleaning process.

The method may also comprise, separately or in combination the following steps: passing the soiled water through a liquid-liquid cyclone, passing the liquid constituents of the solid-liquid cyclone through a liquid-liquid cyclone, passing the liquid constituents of the soiled water through a filter, and/or passing the liquid constituents of the soiled water through a self-flushing filter.

An object of the present invention is to provide a method and apparatus for cleaning one or more surfaces.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
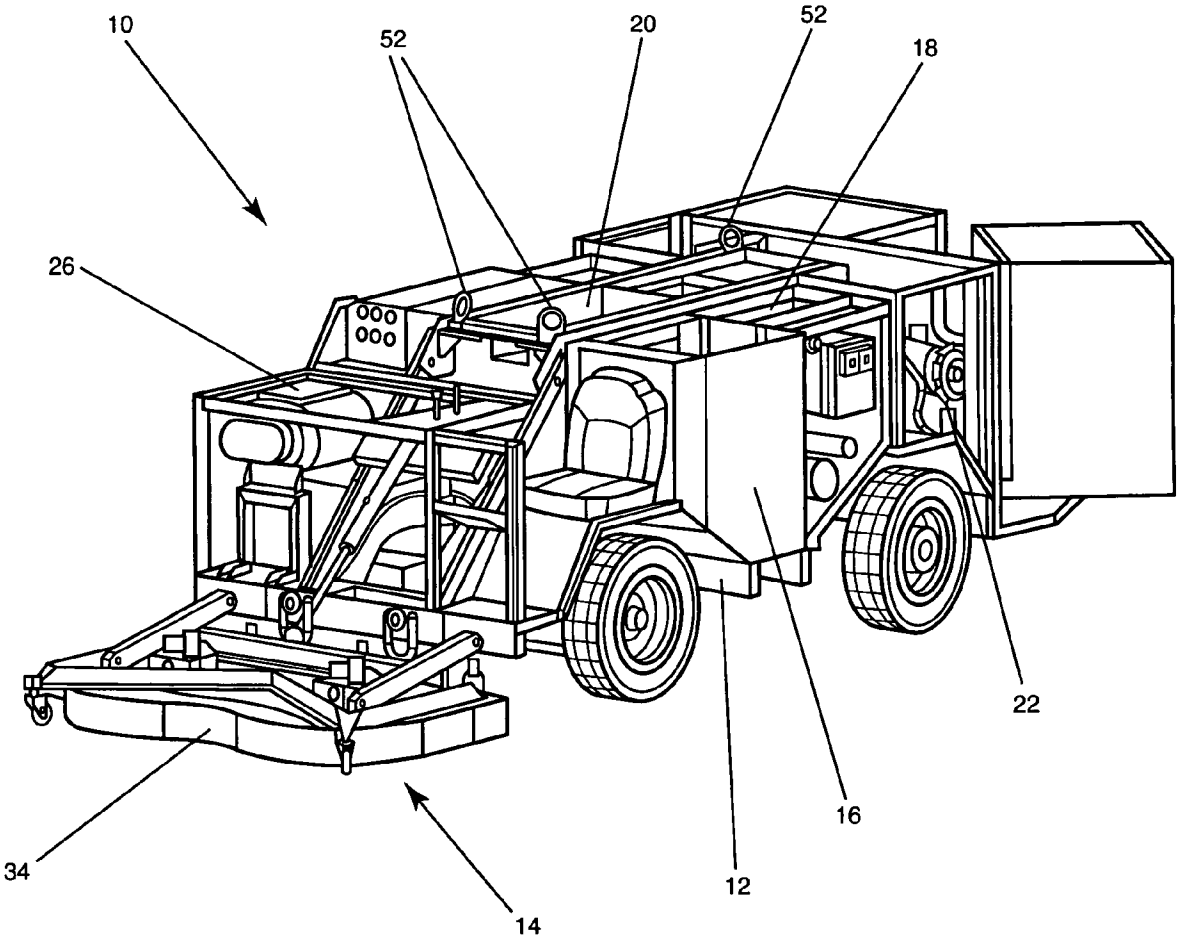
FIG. 1 is a drawing showing a perspective view of the preferred embodiment of the vehicle of the present invention with the cleaning deck in the down position.
Figure 2A:
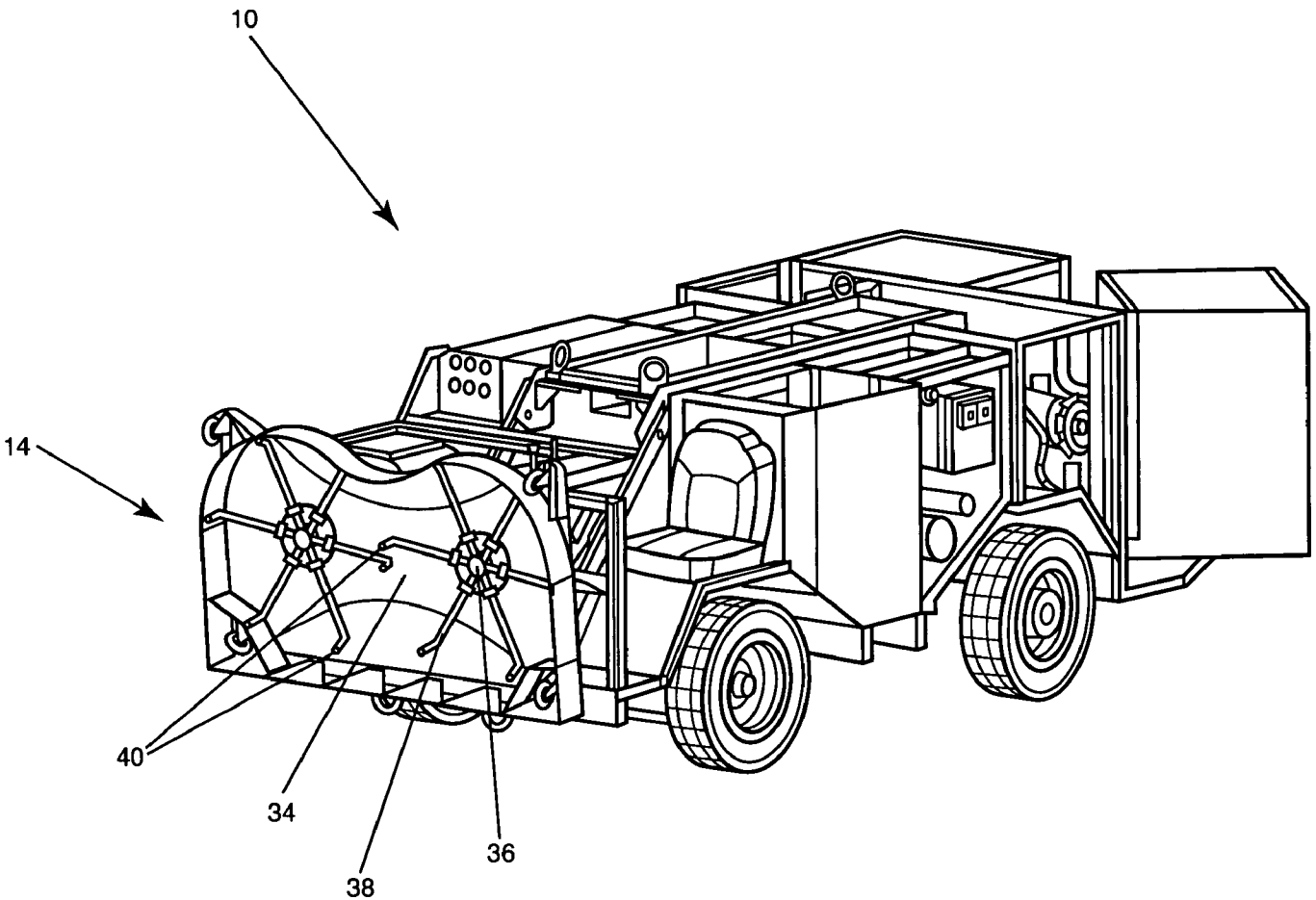
FIGS. 2A, 2B, 3A and 3B are perspective view drawings of a preferred embodiment of the vehicle of the present invention with the cleaning deck in the up position.
Figure 2B:
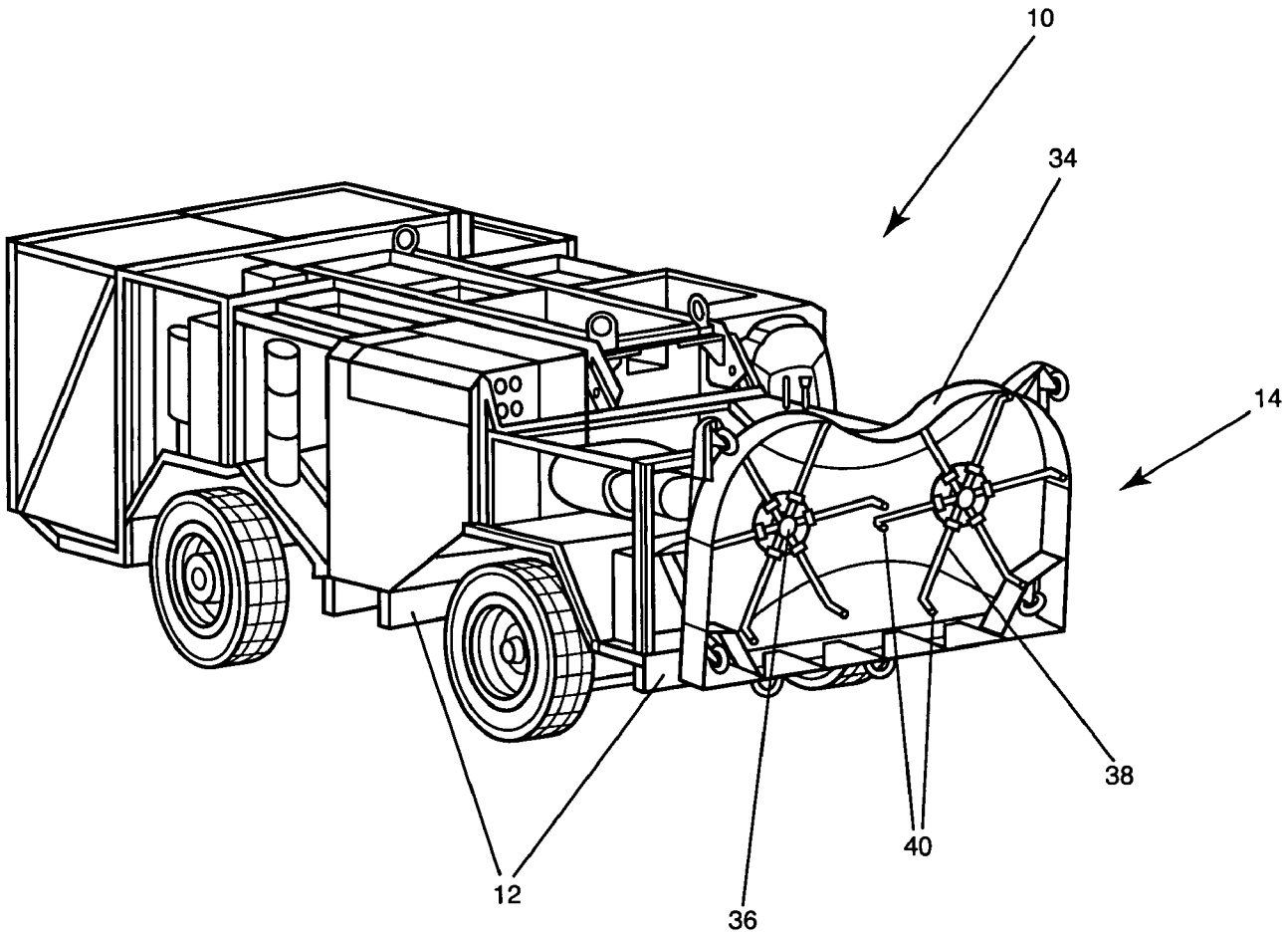
Figure 3A:
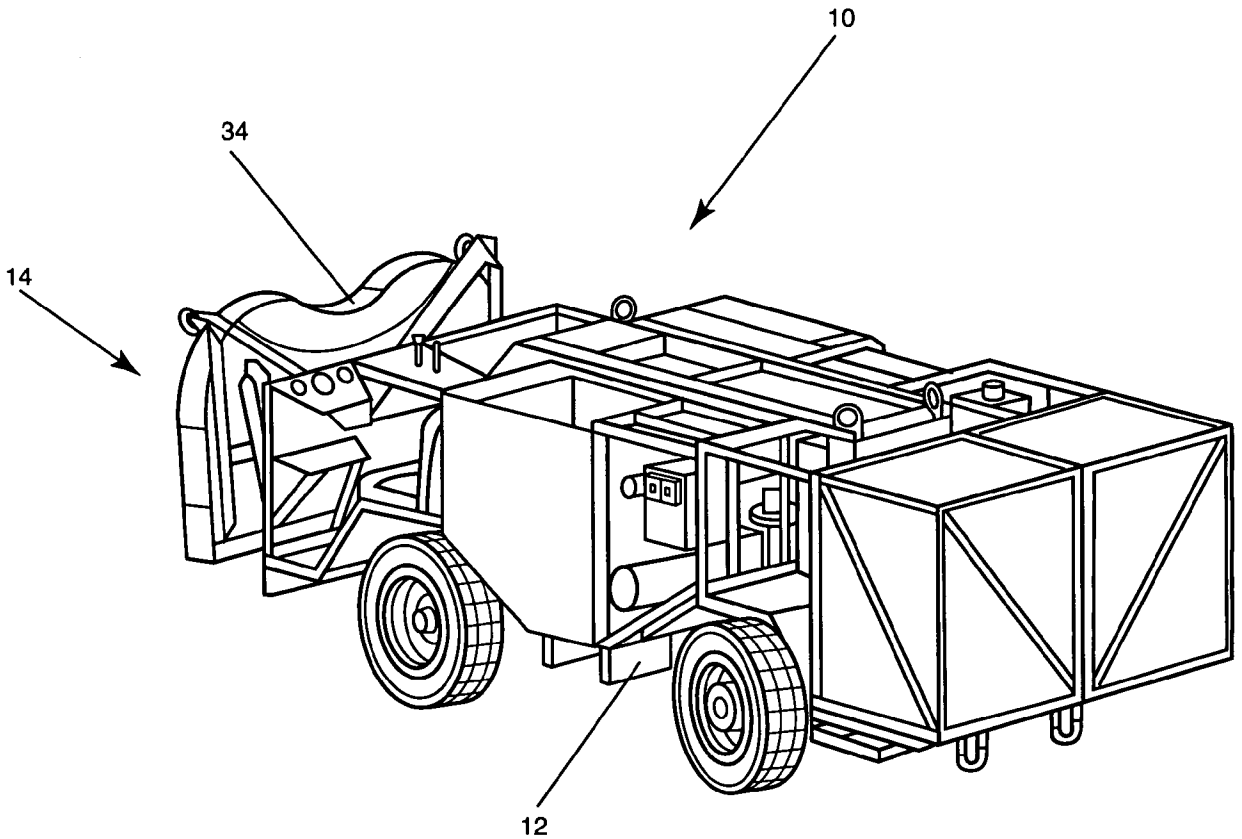
Figure 3B:
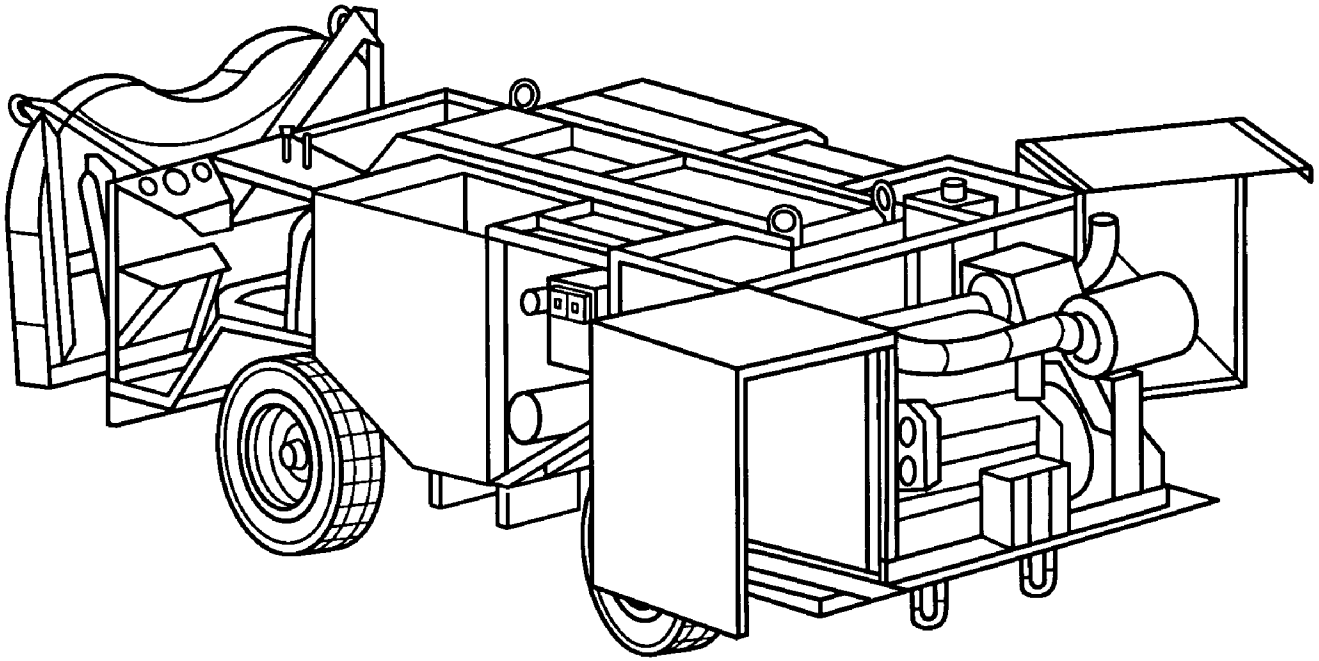

The term "liquid-liquid cyclone" is used interchangeably throughout the specification and claims with the term "liquid-liquid separator". The term "solid-liquid cyclone" is used interchangeably throughout the specification and claims with the term "solid-liquid separator".

The present invention is directed to methods and apparatuses for rapidly cleaning large surface areas. Particularly, the present invention is directed to methods and apparatuses for cleaning runways of aircraft carriers with a mobile cleaning vehicle wherein high-pressure water is sprayed onto the surface before being vacuumed up, processed, and reused. The present invention can be used to remove dirt, oil, particulates, and rubber buildup from any surface which is driven on. Particularly desirable results can be obtained by using the present invention on runways, including both land-based runways and aircraft carrier runways.

Although the vehicle depicted in the figures has four wheels, any other vehicle capable of transporting the various elements of the present invention will also produce desirable results. The term "wheel" and "wheels" as used through the specification and claims is intended to include any apparatus, device, structure, element, as well as combinations or multiples thereof which can be used to enable a vehicle to travel across a surface, including but not limited to wheels, tracks, treads, rails, etc. Further, although the present invention is primarily directed to cleaning surfaces of aircraft carriers, desirable results can be obtained when the present invention is used on a roadway, parking lot, runway, or other similar structure.

The present invention relates generally to a flat-surface cleaning vehicle which uses high pressure water for cleaning while an onboard hydrocyclone-based system processes reclaimed water and returns it to cleaning service. The union of the cleaning/recovery operations with recycle capability allows the vehicle size to remain small since little water is needed to clean a large area. Although the vehicle is physically small, the performance (square ft/hr) of it compares favorably with a much larger vehicle which does not comprise a recycling feature. The cyclone-based water recycle system of the present invention uniquely enables the present invention to recycle recovered wastewater fast enough to permit the present invention to continuously clean with water recycled therewith. The hydrocyclone units are preferably capable of removing solids and oils from the recovered wastewater and returning clean water to the cleaning circuit for re-use.

The recycle unit preferably processes wastewater using two varieties of cyclones. A liquid-liquid (L-L) cyclone removes oil constituents from the wastewater. The L-L circuit preferably ensures removal of oils and greases from the water. The second type of hydrocyclone used is preferably a solid-liquid (S-L) cyclone. This unit preferably removes solid constituents from the wastewater.

An advantage of the present invention is that a relatively small amount of initial cleaning water is required for cleaning a large area. Another advantage of the present invention is that contaminates recovered during cleaning are contained onboard for appropriate and easy disposal.

The present invention is also a system and method for cleaning horizontal surfaces that are contaminated with any combination of oils, greases, particulates, and various other material buildups. As such the present invention can be used to remove rubber buildups from runways. Since the present invention preferably separates what is sucked into the cleaning system into its constituent components, and because the processed water is reused by the present invention, the present invention can preferably operate for extended periods of time on a single tank of washing water and has the ability to store various contaminants which are recovered from the recycled water.

FIGS. 1-3B depict a preferred mobile cleaning, reclamation, and recycling vehicle of the present invention 10. Vehicle 10 preferably comprises vehicle chassis 12 that incorporates cleaning head 14 which is preferably disposed in front of or behind vehicle 10. Vehicle 10 also preferably comprises a vacuum recovery system, effluent containment system 16 ("recovery tank") and cyclone based recycling system 18 which preferably returns processed water to clean water holding tank 20 for re-use. Referring to the figures generally, vehicle 10 is preferably powered by at least one primary power plant 22 which is used for propulsion. Although primary power plant 22 can be used for all power needs on vehicle 10, it is preferable that secondary and tertiary power plants be provided. If secondary and tertiary power plants are provided, it is preferable that they be used to power high-pressure cleaning pump 24 (which preferably generates a pressure of between 4000 to 5000 pounds per square inch of pressure) vacuum blower 26 (see FIG. 1), large solid strainer and pump 28, solid-liquid cyclone pump 30, and/or liquid-liquid cyclone pump 32. While power can be distributed from the one or more power plants in a manner known to those skilled in the art, it is preferable that power be distributed mechanically, electrically, and/or hydraulically.

FIGS. 2A, 2B, 3A, and 3B depict the apparatus of the present invention with cleaning head 14 in a raised position. Cleaning head 14 preferably comprises deck 34, beneath which a plurality of rotary members 36 are disposed. Rotary members 36 preferably comprise a plurality of wands 38 with spray nozzles 40 disposed at terminal portions thereof. When the present invention is in operation, wands 38 with nozzles 40 preferably rotate above the surface to be cleaned. Nozzles 40 rotate with respect to the surface to be cleaned.

A user preferably fills clean water holding tank 20 prior to use. Vehicle 10 is then driven across a surface to be cleaned. Water is pumped from holding tank 20 through high-pressure pump 24 before passing through rotary members 36 and wands 38, whereupon the water is then emitted by nozzles 40. Although high-pressure pump 24 is preferably a single large, high volume, high-pressure pump, a plurality of lower volume pumps can be used and will produce desirable results. Vacuum blower 26 vacuums or sucks air, water, and small solid particulates through deck 34. The air, water, and debris sucked into vehicle 10 by blower 26 are then passed through strainer assembly 42, where the large solids are removed. Similar to high-pressure pump 24, blower 26 is also preferably a single large high volume blower. However, desirable results can also be produced with a plurality of lower volume blowers.

Figure 4A:
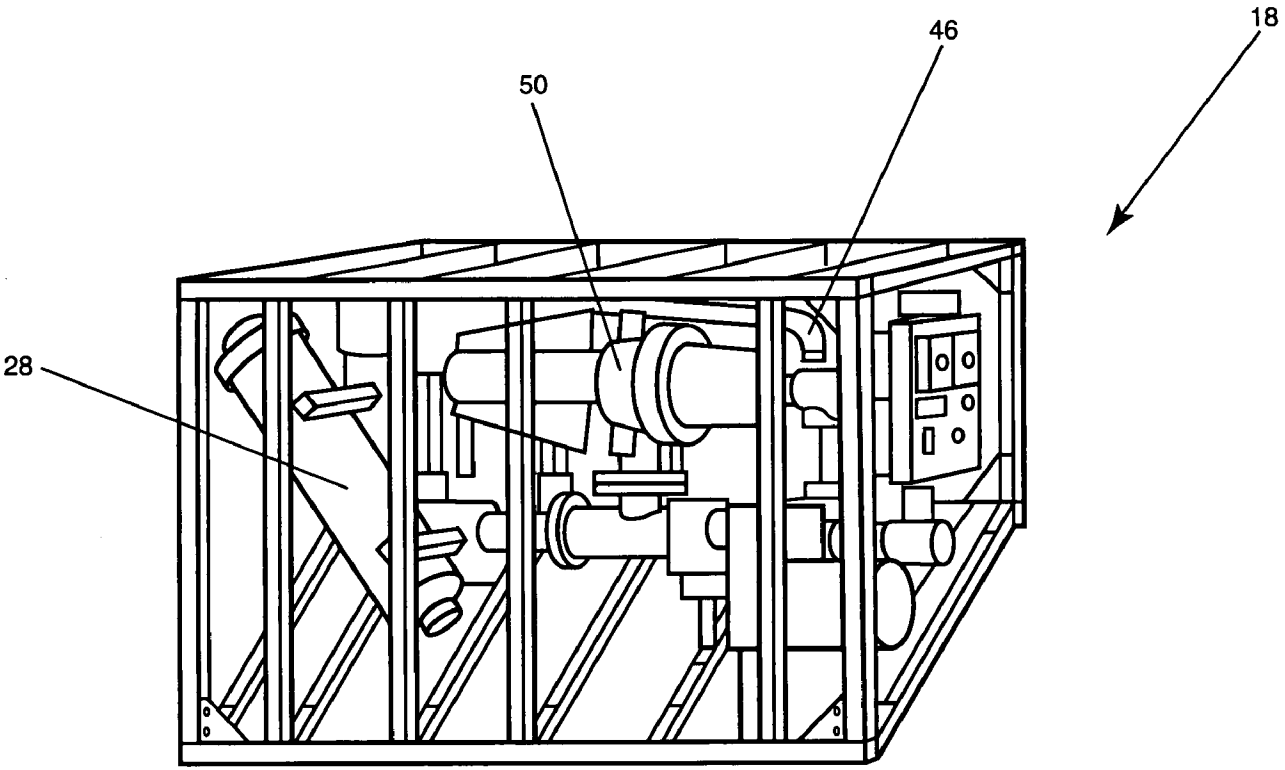
FIGS. 4A and 4B are perspective view drawings illustrating a preferred embodiment of the water recycling system of the present invention.
Figure 4B:
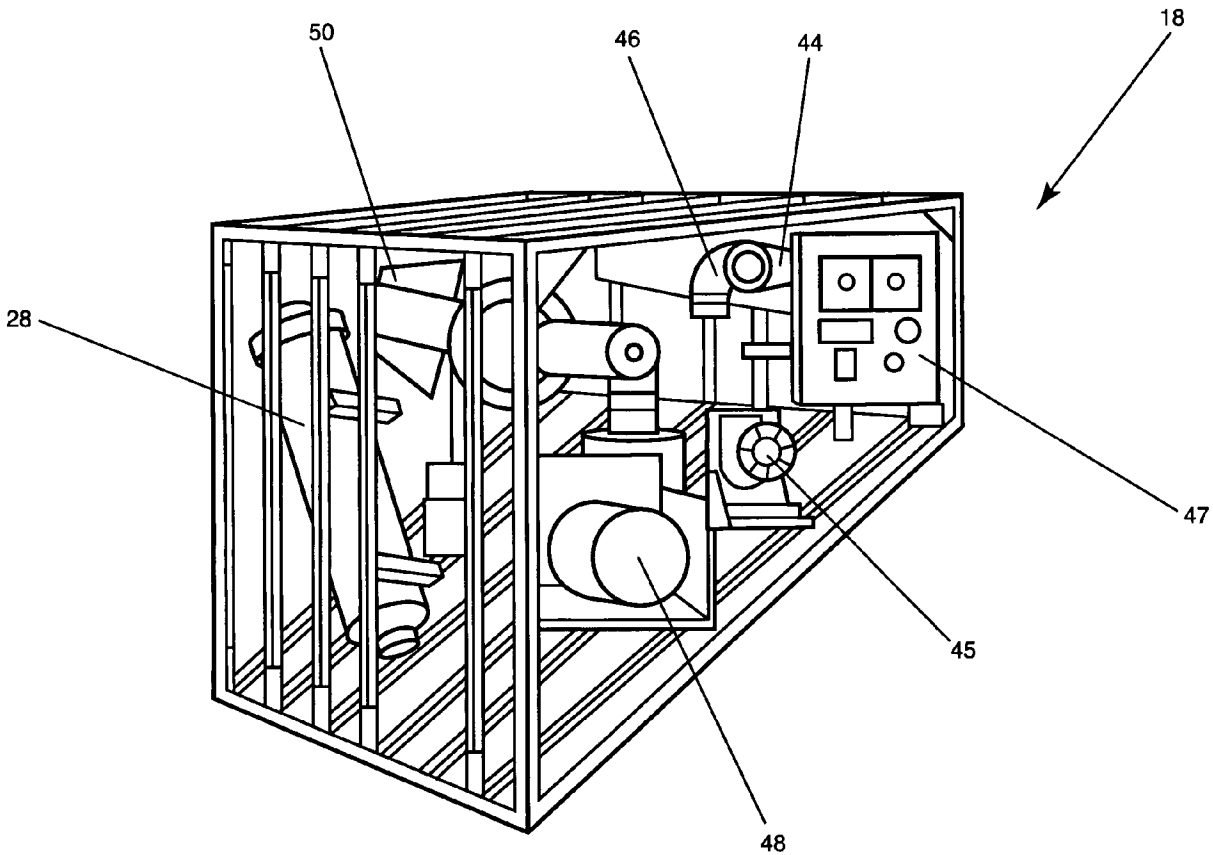

FIGS. 4A and 4B are drawings which illustrate an embodiment of the recycling system of the present invention. The water and small debris then flow into recovery tank 16 before passing through liquid-liquid separator 44 and then solid-liquid separator 46. Liquid-liquid separator 44, which is preferably powered by progressing cavity liquid-liquid pump 45, preferably removes all liquids which are less dense than water. For example, oils and greases are preferably removed from the recovered water by liquid-liquid separator 44. While a number of skimmer type devices can be used to separate liquids, and produce desirable results, a liquid-liquid cyclone is preferably used. Further, the order of the recycling steps is not essential. FIGS. 4A and 4B depict two alternative flow charts which generally illustrate consecutive steps of purification for the recycled wash water. Upon studying this application, those skilled in the art will readily recognize that the steps of purification of recycled water can be rearranged to form numerous combinations of water cleaning steps which can be used to clean the water of the present invention. However, it is preferable that each step be performed at some point. For example, the recovered water can pass through liquid-liquid separator 44 before or after passing through solid-liquid separator 46. Or, separators 44 and 46 can be placed in parallel rather than in series such that both separators simultaneously draw recovered water from and return processed water to recovery tank 16. Optionally, recycling system 18 can include solid-liquid timer module 47 which can be programmed to cycle solid-liquid cyclone 46 on and off at desired intervals.

Smaller size solids are preferably removed from the recovered water by the use of solid-liquid separator 46, which is preferably powered by centrifugal solid-liquid cyclone pump 48. While various devices and methods, known to those skilled in the art, could be used and would produce desirable results, for separating solids from a liquid, a solid-liquid cyclone is preferably employed.

Finally, while not essential to the operation of the present invention, automatic scanning filter 50 is preferably employed which filters any remaining debris just before the recycled water enters the high-pressure pump.

The vehicle of the present invention can also optionally be fitted with a high pressure hose and wand which is connected to an output of high pressure pump 24 such that a user can manually clean an area with the high pressure wand.

In the event that the present invention looses power, a set of pedals is preferably provided such that a user can manually pedal the vehicle to an area to be repaired. Additionally, three or more lift points 52 are preferably provided. Lift points 52 are preferably secured to an upper portion of vehicle 10 and a center of gravity of vehicle 10 preferably resides somewhere within an area bounded by lift points 52.

Figure 5A:
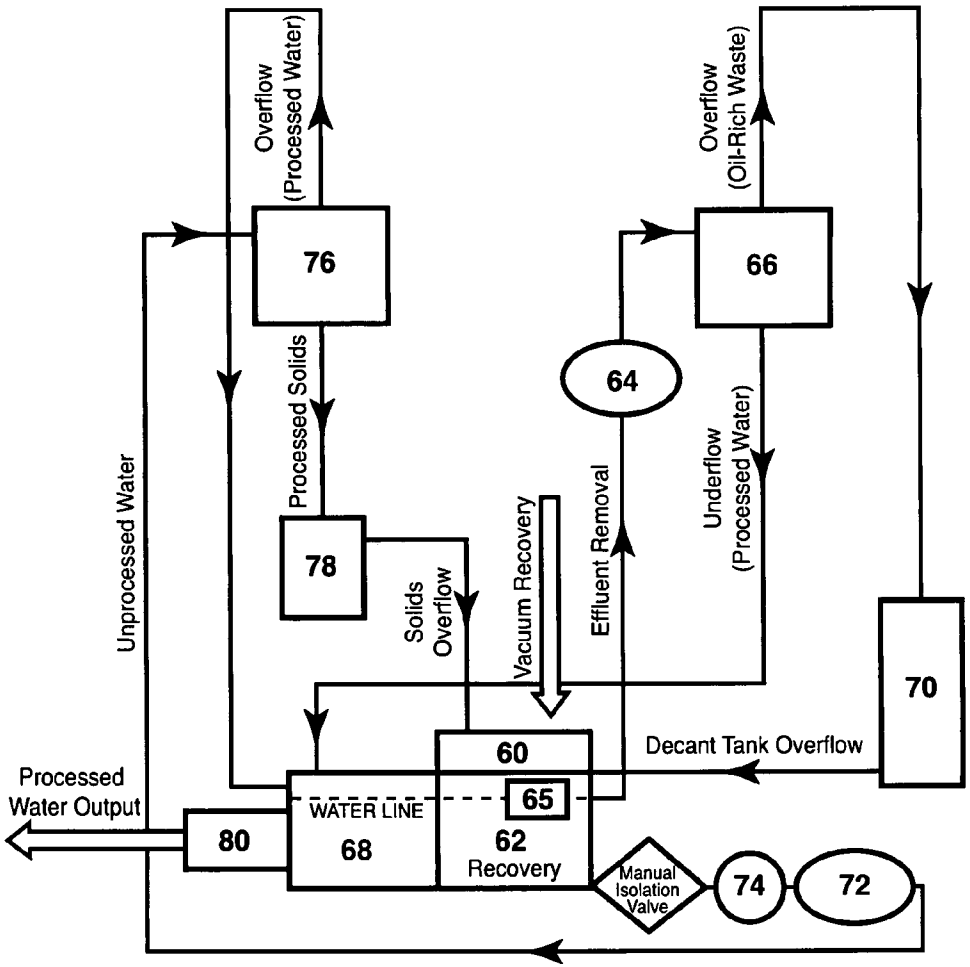
FIGS. 5A and 5B, are block diagrams illustrating alternative configurations of the water recycling system of the present invention.

Referring to the flow chart of FIG. 5A, in one embodiment of the present invention, soiled water preferably enters through the vacuum recovery and passes through screening device 60 before entering recovery tank 62. Pump 64, which can be a progressive cavity pump, preferably removes water from recovery tank 60 through skimmer 65 before passing it to liquid-liquid separator 66. An underflow of liquid-liquid separator 66 preferably flows to processed water tank 68. The oil-rich overflow of separator 66 preferably flows into waste oil tank 70. Pump 72, which is preferably a centrifugal pump preferably pulls water from recovery tank 62 and through large solid strainer 74 before passing the water to solid-liquid separator 76. A manual isolation valve can optionally be disposed between recovery tank 62 and strainer 74. The solids water which is extracted from solid-liquid separator 76 preferably flows into a solids waste pot 78. An overflow from solids waste pot 78 can optionally be installed such that the overflow returns to recovery tank 62 through screening device 60. The overflow of processed water from solid-liquid separator 76 preferably flows into processed water tank 68. In-line, scanning, self-flushing, polishing filter 80 is preferably disposed at an outlet of processed water tank 68, water which passes therethrough is then re-used for cleaning purposes. In addition, one or more settling tanks can be provided to facilitate the settlement of the reclaimed water.

Figure 5B:
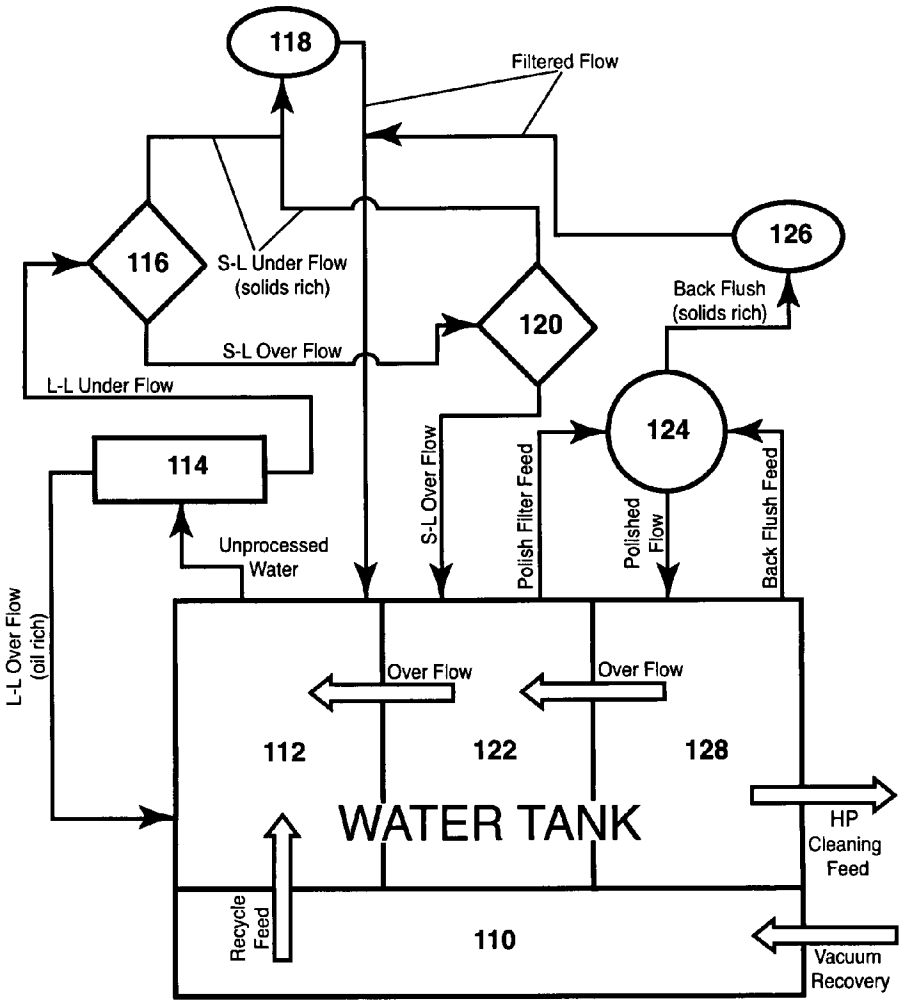

Referring to the flow chart of FIG. 5B, in another embodiment of the present invention, waste water preferably enters recovery tank 110 before passing to optional first storage tank 112. The waste water then preferably passes to liquid-liquid separator 114. An oil rich overflow of L-L separator 114 preferably re-circulates back into optional first storage tank 112. The underflow of separator 114 preferably travels to first solid-liquid separator 116. Waste water from the underflow side of the solid-liquid separator 116 then preferably travels to optional first filter bag 118. If optional first filter bag 118 is used, then the water which passes therethrough preferably returns to optional first storage tank. The purified overflow of first solid-liquid separator 116 preferably flows into second solid-liquid separator 120. The purified overflow water which emerges from second solid-liquid separator 120 preferably passes to second optional storage tank 122 while the underflow of dirty water emitted from second solid-liquid separator

120 preferably passes through optional first filter bag 118. A polishing filter, such as self-flush filter 124 is preferably provided and draws water from second storage tank 122. The back flush from self-flush filter 124 preferably travels to optional second filter bag 126. The output of optional second filter bag 126 preferably flows into optional first storage tank 112. The purified water which does pass through self-flush filter 124 preferably flows into clean water storage tank 128 where it is held before it is passed on to a high pressure pump for re-use. Upon studying this application, those skilled in the art will readily recognize that one or more pumps can be installed in numerous places throughout the block diagram of FIG. 4B such that water is caused to flow to the various elements of the diagram. In addition, one or more settling tanks can be provided to facilitate the settlement of the reclaimed water.

The cleaning effectiveness of the present invention is far superior to the prior art with respect to its ability to restore the coefficient of friction on non-skid deck surfaces at shorter intervals than previously practical. Particularly, when the present invention is used to clean aircraft carrier decks, numerous benefits are realized over the prior art. These benefits include: 1) quality of life is enhanced for persons who are no longer forced to clean large surface areas by hand with soap; 2) the elimination of soap use for primary deck cleaning enhances the environment; 3) vast reduction in water usage for deck cleaning because water can be re-used by recycling it over 16 times per hour; 4) reduction in the use of salt water in spray down leads to less corrosion.

INDUSTRIAL APPLICABILITY

The invention is further illustrated by the following non-limiting examples.

Example 1

By way of example, the following is provided to describe in greater detail a preferred embodiment of the present invention:

Although all components are not essential, a preferred embodiment of the present invention preferably includes:

Integrated cleaning-recovery and wash water recycle system 10,000 $ft^2$ per hour-25,000 $ft^2$ per hour cleaning productivity rate 6' wide integral cleaning head The vehicle is capable of four wheel steering with selectable 2 wheel steering mode The vehicle of the present invention preferably has a 11.6" 4-wheel steering turning radius (outer wheels)

Hydrostatic drive mechanism capable of variable speeds from 0.4 to 5 mph

Single 126 hp diesel engine

"Remote" pressure washing attachment for manual touch-up cleaning 10-12" ground clearance 60" overall height Several safety features including: "Dead-Man" pedal and automatic brake with the loss of hydraulic pressure.

Secured fasteners

Hand operated parking brake

Towable after primary power failure

Low chassis tie-downs

Lift points

Foam filled tires

Weight placard

Center of gravity marked

Figure 6:
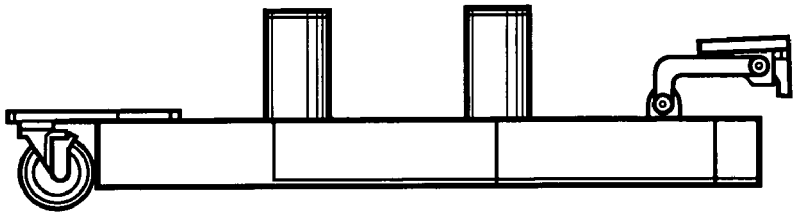
FIG. 6 is a perspective view drawing illustrating the cleaning deck of the present invention in raised and lowered positions.
Figure 6:
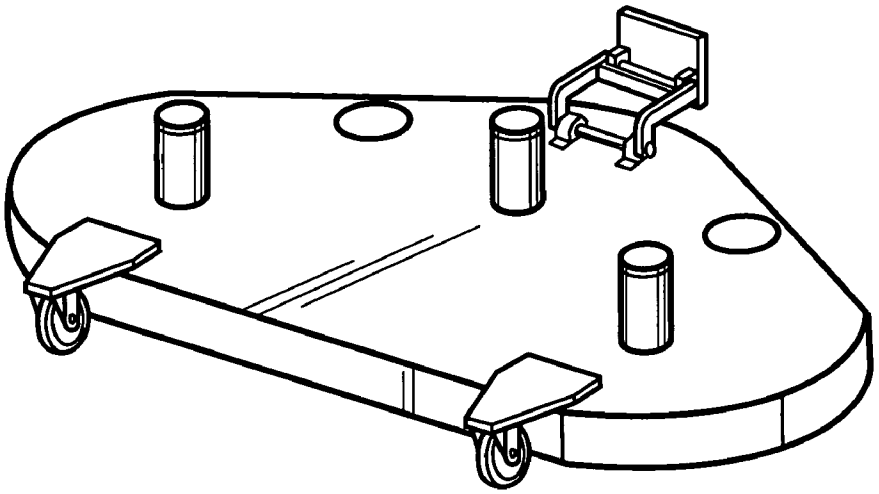

As depicted in FIG. 6, an embodiment of the cleaning system of the present invention preferably comprises a "floating" cleaning deck (e.g. approximately six feet wide) that utilizes rotary bars with attached 15° spray nozzles. The deck preferably has in-position vertical articulation to 10 inches (not to be confused with the tilt articulation shown in FIG. 6) in order to clear arresting cables or other obstacles. Additionally the deck preferably has a stowage articulation capability to swing up for improved storage and nozzle access/maintenance.

A nylon brush skirt (not shown) preferably surrounds the deck circumference but allows an adequate column of air through to accommodate the vacuum recovery chamber located directly behind the cleaning chamber as shown. The inner-wall separating the cleaning and recovery chambers is offset to allow positive air velocity in order to extract air and water from the deck surface. A hydraulically driven lobe-blower is preferably used to extract air and water from the deck surface. The recovered material is then processed by the onboard wash water recycle system. In this embodiment, the wash water recycle system of the present invention is designed to process recovered wash water from the cleaning deck and return it to the pressure cleaning system after removing undesirable solid and liquid constituents. The wash water recycle system preferably employs a cyclone separation method that enables the vehicle to operate for long durations of time.

The solid-liquid (SL) and liquid-liquid (L-L) cyclones are preferably selected for continuous operation while the vehicle is cleaning or driving to a new cleaning location. This allows a continuous processing and re-processing of wash water while the vehicle is in operation. The system effectively reduces oil and solids concentrations by continuously removing oil and solid constituents. The use of cyclone separation preventative maintenance preferably comprises removing waste oil and a canister containing solids once they fill to capacity.

Cyclone separation provides the present invention the ability to run for extended periods of time independent of a volume throughput limitation. Most filters have a limit on the amount of solids or oil that can pass. At any given concentration a filter will last only for a certain volume of water passed though it. The recovery/clean water onboard tank design also preferably improves the space-saving aspects of the invention.

A single U2-gMAX 3020 S-L urethane cyclone has been found to produce particularly desirable results and is specified to meet the 15 gpm throughput requirements. Desirable results can also be produced by using two smaller L40-gMAX L-L cyclones in parallel. A single pump can optionally feed both cyclones and inlet and outlet connections can be shared.

The wash water recycle module preferably runs in a continuous mode operation rather than batch mode. The tank design preferably allows for a continuous mode operation without run-dry risk. Optionally, continuous mode can run any time the vehicle is in operation. The result is a "turnover" of the primary holding tank every 16 minutes. The recycle system flow rate (e.g. 15 gpm) is preferably closely matched with the pressure system's deposition rate so the continuous mode filtration has a redundant effect on water quality.

Figure 7:
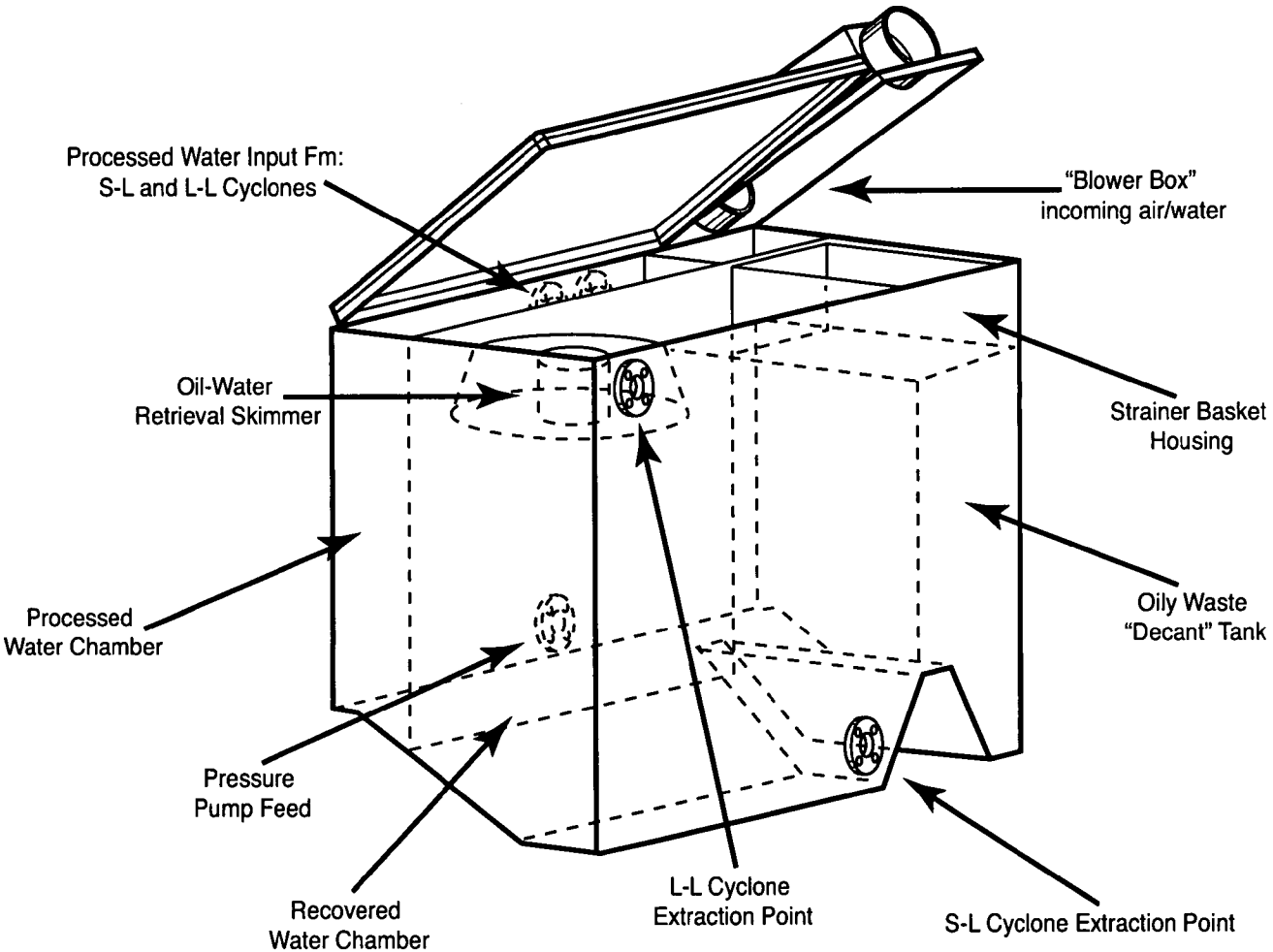
FIG. 7 is a drawing illustrating a tank assembly of the present invention.

The onboard water tank is preferably designed to house in-process waste water as well as processed water used for the pressure cleaning cycle. The tank design uses a novel interconnected "weir" to achieve fluid balance, as there is continuous fluid processing taking place even if the vehicle is not cleaning. The combined water capacity is 250 gallons. The oily waste decant tank holds up to 60 gallons of oil waste. As illustrated in FIG. 7, the recovery side incorporates a sloping bottom combined with S-L cyclone placement to encourage solids departure towards the S-L cyclone outlet. An oil skimmer assembly collects oily water from the surface of the tank, then delivers the mixture to the L-L cyclone for processing. The vacuum recovery inlet incorporates flow-through housing with a particulate basket to catch approximately ⅛" diameter particles and above. A recessed vacuum inlet placement (not shown) can be used to reduce the height of the tank, thus reducing the height of the overall vehicle. There are preferably two pumps used for cyclone operation. S-L cyclone pump: A solids tolerant open impeller centrifugal pump can be used and produces desirable results. The pump is preferably sized to operate continuously during vehicle operation and preferably is designed to handle semi-corrosive liquids (salt water) and solids up to about ⅛" in diameter.

With respect to a preferred L-L cyclone pump, a low-shear dual stage progressing cavity pump is used to retrieve water from the onboard water tank by way of a floating skimmer. Dual stage functionality allows reduced rotational speed and less shear caused on the liquid being pumped. The pump is preferably sized to run continuously during vehicle operation.

In the preferred embodiment shown in FIG. 1, the vehicle of the present invention is preferably primarily powered by a diesel engine. The engine preferably produces continuous horsepower (e.g. 126 hp) and runs a primary hydraulic pump which in turn operates vehicle mobility and steering. The engine can also provide direct drive rotational power to the primary water cleaning pump. The engine is preferably accessorized with a secondary hydraulic pump that powers two circulating pump motors and the vacuum recovery blower.

The engine selected preferably comprises the following attributes:

140 hp @ 2400 rpm intermittent 126 hp @ 2400 rpm continuous

Peak torque 367 ft lbs @ 1400 rpm

Tier II compliant, required by US EPA for all certified engines

Emission requirements met without degradation of engine performances or power level Quick engine change capable 24 volt electrical system The vehicle chassis of the present invention is preferably based on a fusion welded reinforced ladder bar frame design using, e.g. ASTM A500 Grade A or B rectangular tube, plate, and some common structural shapes. An epoxy or polyester thermoset powder coat finish can optionally be applied wherever possible.

Some preferable attributes of the vehicle of the present invention comprise:

The vehicle is preferably capable of four wheel steering with selectable two wheel steering mode.

The front and rear axle/steering suspension components are preferably identical.

All wheel hubs preferably have the same bolt pattern so all four wheels are interchangeable.

Hydrostatic differential steering with conventional steering wheel control is preferably used.

The frame preferably comprises four low chassis tie down points.

The frame comprises four lift points, (no spreader bar is needed).

Compact planetary gear reduction wheel drive with integral variable speed hydraulic motor.

The steering-braking systems are each preferably in an isolated circuit for safety purposes.

Particularly desirable results can be achieved with the pressurized water set to a pressure of 5000 psi at 15 GPM. This parameter range is desirable because it provides cleaning effectiveness while the components needed to generate such a pressure and flow rate are still relatively small. A positive displacement triplex plunger pressure pump can be used to produce desirable results.

In one embodiment, the onboard recycle system should be preventatively maintained by removing solid and oil waste from the vehicle. The separate solid-liquid and liquid-liquid cyclone systems preferably denote the two separate offloading requirements for the vehicle after a cleaning cycle has been completed. The oil waste is preferably contained in the "decant" tank where a hose can be connected for offloading into the oily waste holding tank (e.g. on a ship). The solid waste is contained in the S-L cyclone "grit-pot" and is retrieved by a detachable grit pot (assuming another is on hand) or a bucket container put in position (below the grit pot) while a ¼ turn valve is turned.

The pressure cleaning and reclaim system is preferably controlled with a single switch. The switch actuates the vacuum reclaim pump and the pressure cleaning heads. A clearly visible two state indication lamp is used to show operation status of cleaning heads. In the event of stop-standing, the operator is preferably trained to recognize that the unit is actuated and it is thus necessary to switch the cleaning system off. An addition to this method includes a simple interlock system that uses the vehicle travel speed to determine the operation status of the cleaning/recovery system. The mechanism can be a simple AND gate logic circuit where the pressure system can only be operated when the vehicle is traveling greater that a predetermined speed AND the switch is in the on position.

Example 2

An embodiment of the present invention was constructed and tested. However, before testing of the cleaning effectiveness of the present invention was attempted, a study of available nozzle types was done. The nozzle types surveyed included standard 0-80 degree 1-piece metallic nozzles to multiple component (single head) designs that incorporate a spinning mechanism. Several proprietary designs were examined that did purport performance beyond typical single piece nozzles. The cost and reliability issues of these rotating nozzle types weighed against their adoption.

The deck width of six feet and a goal of 10,000 $ft^2$ per hour cleaning rate dictate a forward travel speed of approximately 0.4 miles per hour. This speed range was used to qualify the cleaning requirements and rotating nozzle design. A 2" stand off distance is recommended to avoid contact between the rotating nozzle head and any deck level obstructions which are likely to be encountered on a deck of an aircraft carrier. If practically possible, the standoff distance is preferably less due to impingement effectiveness being higher with less distance. However, 2" shows acceptable performance. Measurements taken showed a maximum clearance of 1.75" and a ¼" margin of safety was added for a total of 2".

A positive displacement pump type was selected due to maintenance advantages compared with other types of pumps. A number of manufacturers provide suitable pumps for the apparatus of the present invention. The factors considered were: maintenance issues such as packing type and seal composition, water quality requirements, location of manufacture in regards to spare parts availability, and most importantly, the actual size of the pump versus the pressure and flow rate capabilities.

The largest challenge in selecting a pump lies in the form factor of the actual pump. The pressure and flow range generally dictate that the pumps are outside the "water blasting" market. Numerous manufacturers offer triplex PD pumps in the parameter range selected. Pumps are selected based on strong maintenance advantages and seal composition compared with other pumps. A stainless steel "liquid-end" and low-seal-wear ceramic plungers are also a factor. Seals comprise solid EPM and are expected to operate for 2000 hrs at a water quality level of 5-20 microns. Valves in the unit are expected to operate for 3000 hrs. Basic energy calculations were made based on 5000 psi and 15 gpm in order to determine the effects of water recycling. The calculations yield 55° F. temperature rise in one hour. This level does not require a heat exchanger in order to protect pumping or delivery equipment.

Two main methods of high pressure water delivery were found to exist. First is a spray bar manifold (using various types of nozzles) and second is a type of rotating arm that increases coverage (area per nozzle used). For example, using a 2" high spray bar (nozzle tip-surface) and 40 degree nozzle tips requires 50 nozzles to be used in order to cover a six foot wide spray path.

During testing, a single spray nozzle at equivalent standoff distances fared poorly compared with a rotating head surface cleaner. The rotating spray bar, by use of standard nozzle tips and a singular rotating swivel, is used in a majority of industrial cleaning applications. Only rotating spray bar designs were used. Testing was conducted using lower pressures and a rotating head surface cleaner.

The cleaning effectiveness of the present invention was tested on a surface with a non-skid coating. A pressure range of 3000 psi-10000 psi was tested on a soiled plate of nonskid. 0-15 degree nozzle tips were used with varied flow rates within the nozzle type. A standalone 15 degree fan spray nozzle tip running at 4000 psi using 2.5 GPM was tested with success. This was followed by a rotating spray bar assembly tested using the standalone resulting parameters. The rotating spray bar performed well at the higher 0.79 mph travel speed range. Testing revealed that a shorter standoff distance improves cleaning performance. Dual travel speed settings were tested to simulate a "restoration" cleaning and maintaining cleaning parameter set. It was found that 0 degree tips provided the best impingement but the least in coverage efficiency. 15 degree tips provided a practical best between impingement and coverage.

Vehicle travel speed, stand-off distance and water pressure/flow rate were significant variables during testing. The water pressure and flow rate determine the rotation speed (RPM) of the cleaning swivel arms. Resultant RPM produced acceptable cleaning results by angling the nozzles to rotate the swivel assembly. The non-powered RPM may be adjusted slightly by varying the relative angle of the nozzles. While adequate cleaning is accomplished with self-rotating swivels, both powered-rotation and self-rotating swivels are useful in accordance with the present invention. The swivel assemblies specified are capable of operating with both powered and self-powered modes. A powered assembly allows greater nozzle impingement by angling nozzles perpendicular to the deck surface.

Figure 8:
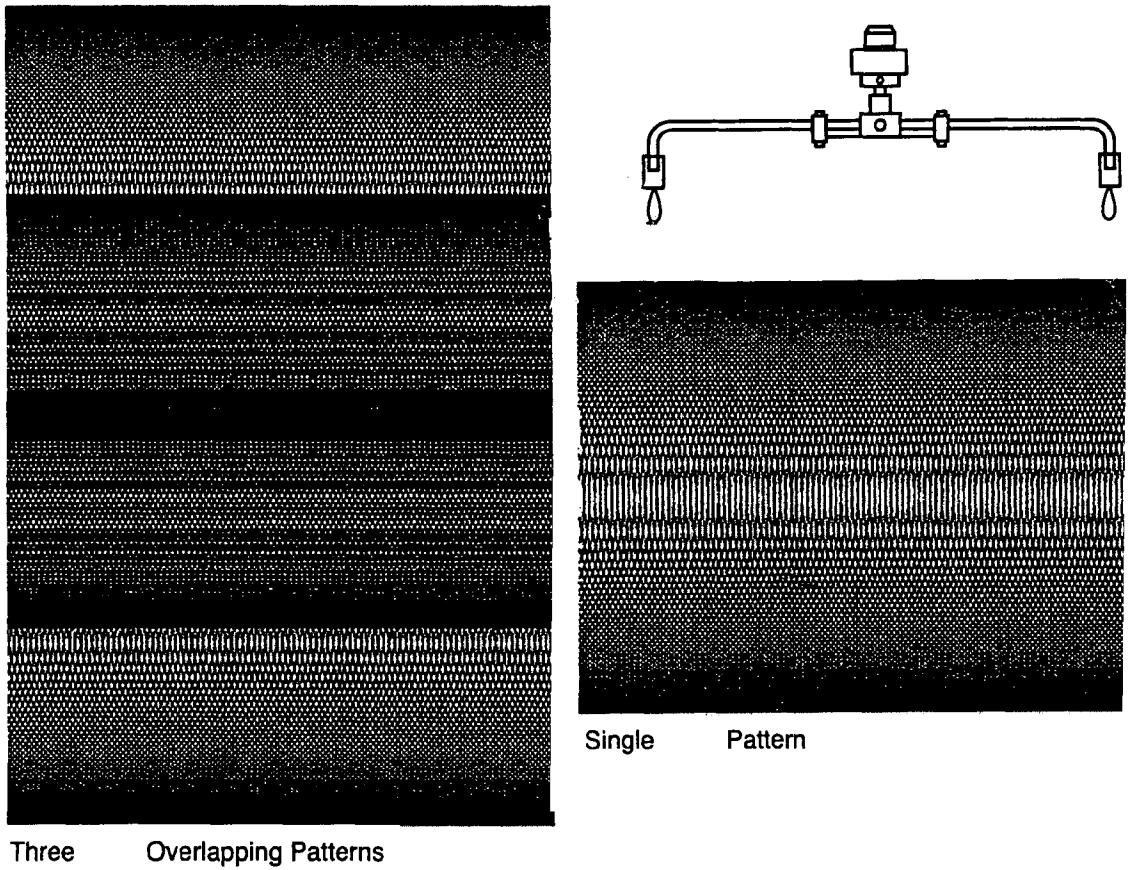
FIG. 8 is a drawing illustrating cleaning spray overlap patterns produced by the apparatus of the present invention.

By using a six foot cleaning path, several possible combinations of rotor placement exist. A two rotor design and a three rotor design are useful due to a flow rate capacity of 15 GPM. The figures below show striation placement "striping" of the cleaning path at travel speeds that correspond to 10,000 $ft^2$/Hr and 25,000 $ft^2$/Hr cleaning rates. FIG. 8 illustrates the coverage patterns generated by the present invention in accordance with the following parameters:

Stand off distance 2"
15 deg nozzle type
0.72 mph forward travel speed
(3) 38" diameter free spinning spray bar arm assemblies
25,000 $ft^2$/hr cleaning rate The test concluded that there were no spaces larger than two inches as gaps. The corresponding fan spray width at 1.9 inches was two inches in width.

A non-skid surface was soiled. The surface was cleaned at various travel speeds and pressures. Only pressures up to 3500 psi were tested. A rotating head surface cleaning device was used for testing. A single fan tip was compared with the rotating spray arm method of cleaning. The non-skid was sent to a supplier for cleaning testing. The supplier used an ultra high pressure positive displacement pump in conjunction with a pressure regulating mechanism to produce various pressures for surface cleaning. A 0 degree rotating spray bar nozzle tip assembly combined with vacuum recovery was evaluated.

A pressure range of 4000-10000 psi was evaluated. A positive displacement pressure pump combined with the water swivel for rotating spray bars was found to be effective.

Cyclone separation is an important component in the vehicle of the present invention. A key benefit that a cyclone offers is that a very large amount of solids and oil can be processed without attention to the cyclone devices. The cyclone method of separating solids and oil from recovered wash water is effective and is preferably a component in the wash water recycle system. Water quality results show that a standalone cyclone does not produce the highest quality water for recycle or discharge; however the levels of oil and solids in treated water using cyclones are close to acceptable discharge and recycle levels. A fine "polishing" stage self-flushing filter is preferably incorporated into the apparatus.

The effectiveness of cyclone separation is an important issue pertaining to the overall mobile cleaning vehicle apparatus. Off the shelf units (normally incorporated in stationary applications) show a 15 GPM (and higher) flow rate with a small footprint. Other factors that affect the incorporation of cyclone separation are form factor, reliability and cost. The tested cyclone unit was rated at 15 GPM flow rate.

Figure 9:
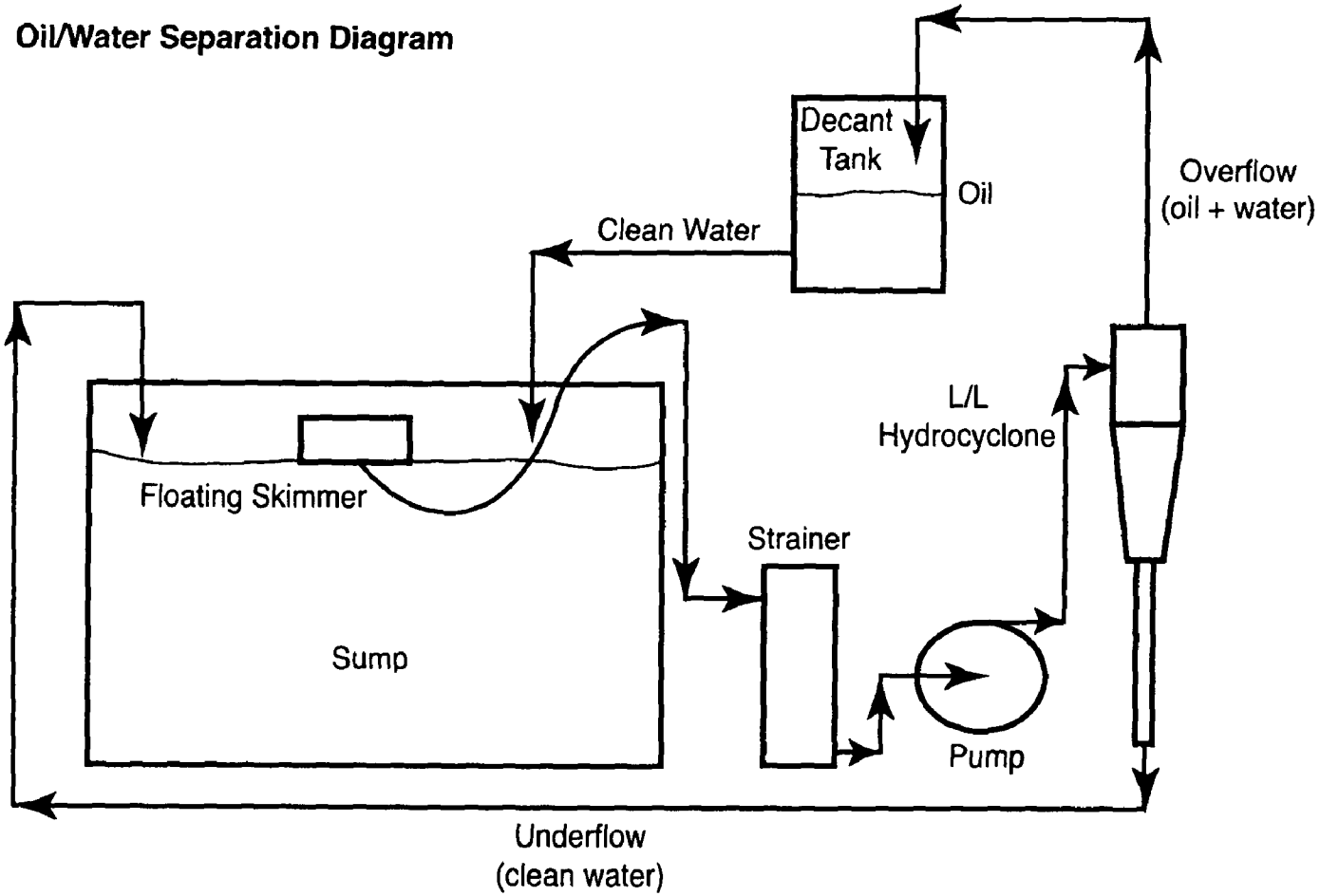
FIG. 9 is a drawing illustrating an oil-water separation diagram of the present invention.

In order to establish realistic testing conditions, results were obtained that show solid and oil concentrations from a sample aircraft carrier cleaning. Tests were performed and a test plan was formulated that called for a Liquid-Liquid (de-oiler) cyclone and a Solid-Liquid cyclone separately. The following conditions were used to develop a test plan that was executed:

(Test Plan Assumptions)
a. Effluent Composition
  i. Sample Solid Content*:
    7130 mg/L (median)
  ii. Sample Oil/Grease Content:
    1173 mg/L (median)
    mg/L1:1 ppm FIG. 9 illustrates an schematic diagram of an oil/water separation scheme of the present invention.

Oil composition comprised of an equal mixture containing diesel fuel, hydraulic oil and way oil. Table 1 listed below shows a relationship between "slugs" (oil concentration being added to main tank) and samples taken from the "underflow" (L-L cyclone processed water port).

TABLE 1

L-L Cyclone Experiment Results

| Time (min.) | Slug Size (ml) | Calculated concentration. (ppm) (see Test Discussion and Notes) | Under Flow Sample #ID | Lab Results Mg/l oil conc. |
|---|---|---|---|---|
| 0 | 500 | 587 | Observe only | x |
| 15 | 500 | 587 | Observe only | Surface is clear before second slug is added |
| 20 | x | 440 | 1 | 48 mg/l |
| 30 | 200 diluted with 300 water.*** | 133,000 | 2*** | 44 mg/l |
| 40 | x | Residual only. | 3 | 87 mg/l |
| 47 | 500 | | x | x |
| 50 | 500 | | x | x |
| 60 | x | 270 (based on 230 ml oil remaining) | 4 | 93 mg/l |

Total tank contents = 225 gal.

Time to recycle at 15 GPM: 15 minutes.

***The concentration is calculated as follows: 200 ml oil concentrate + 300 ml water + 1000 ml water recovered. The sample was taken 1-2 seconds after the mixture was added directly into the skimmer. (at ~60 l/m flow rate) 1-liter of additional water was added into the mixture: 200 ml oil + 1300 ml water = 133,000 ppm oil concentration.

Test Discussion and Notes

Samples were added to the sump with minor agitation. The samples were not fully diluted with the sump water. As a result the intake concentration (at skimmer) was much higher than the calculated concentration that account for the entire fluid volume.

Sample 2 was unique due to the oil concentrate being added directly into the skimmer. The sample was taken immediately after the slug was added. The lab results returned the lowest measurement of the lot. This may be explained by virtue of the sample concentrate containing less segregated oil droplets. The relationship between oil droplet size and recovery rate is shown in the L-L cyclone settings.

Test results ranged from 44-93 mg/l. The similar values of the range may indicate that soluble constituents were present in the overflow. It is thought that the removal of the free product (mixture bound constituents versus in-solution) will remain very high. The mixture used was also considered to account for any TPH (total petroleum hydrocarbons) components that jet fuel may contain. These constituents may be largely responsible for the measured content but since the content percentages are very close to discharge levels the cyclone method was considered a success.

Figure 10:
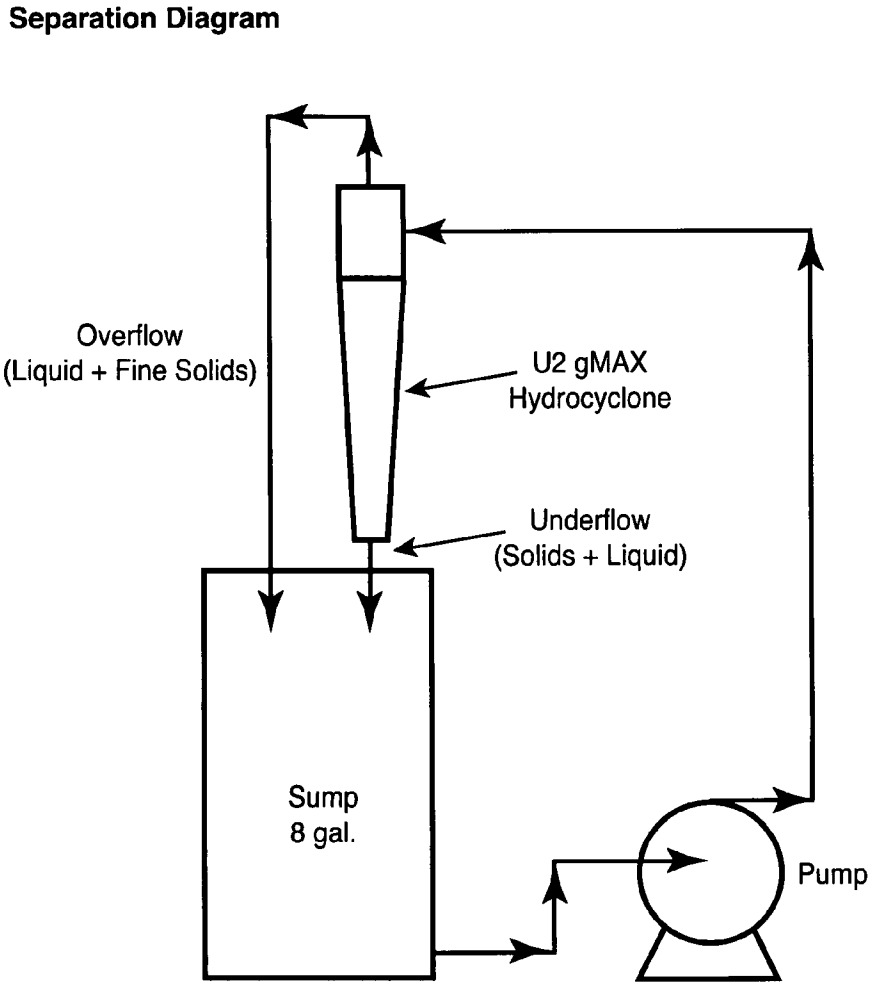
FIG. 10 is a drawing illustrating a solid-liquid separation diagram of the apparatus of the present invention.

FIG. 10 shows a diagram of the testing apparatus. All samples were taken simultaneously as the solid samples were added. Test duration was a period of 35 minutes where various slugs were added to the sump and samples were taken. The samples were retrieved by placing a sample container below the cyclone underflow immediately after the slug had been added to the sump.

Test Sample Solids Composition

Slug 1: Low specific gravity coarse sample comprising IX Resin with a specific gravity of 1.2-1.4

Slug 2: Fine particulate comprising paint chips, sand and ground dirt, and used sand blast media combined with larger particles as found in sample 1.

Slug 3: Very fine particulate comprising IX resin S.G. 1.2-1.4<10 um

Figure 11:
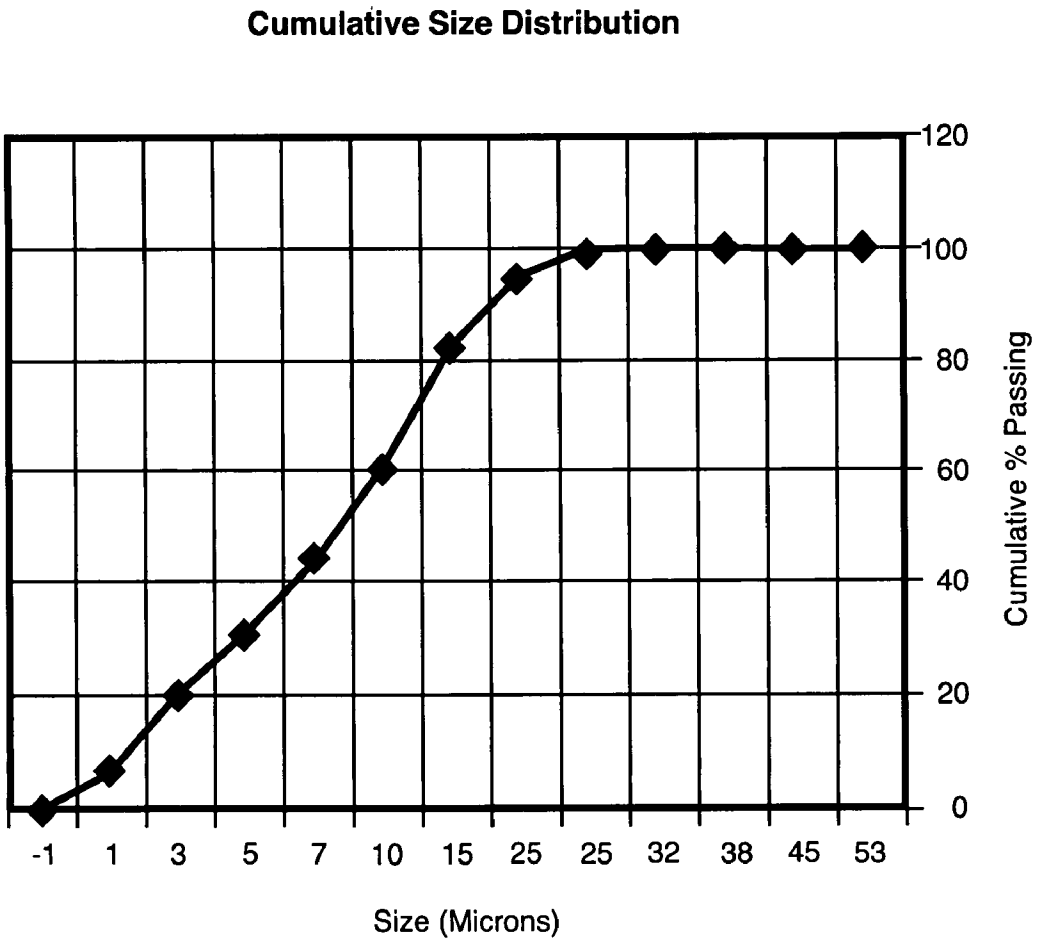
FIG. 11 is a graph illustrating the results of the solid-liquid cyclone test results.

FIG. 11 illustrates a graph of the solid-liquid cyclone evaluation results.

The preceding examples can be repeated with similar success by substituting the generically or specifically described operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above and/or in the attachments, and of the corresponding application(s), are hereby incorporated by reference.

What is claimed is:

1. A mobile cleaning apparatus for cleaning large surface areas comprising:

one or more wheels;

a clean water supply tank;

a high pressure pump;

a vacuum system comprising an inlet, said vacuum system disposed wholly above a surface to be cleaned; and a water processing unit comprising:

a recovery tank and at least one solid-liquid cyclone, said solid-liquid cyclone comprising at least two outputs, one of said outputs comprising an overflow output that returns fluid to said recovery tank, and another of said outputs connected to a solids waste pot.

2. The apparatus of claim 1 wherein said water processing unit further comprises a liquid-liquid cyclone.

3. The apparatus of claim 2 wherein said solid-liquid cyclone is connected in series with said liquid-liquid cyclone.

4. The apparatus of claim 2 wherein said solid-liquid cyclone is connected in parallel with said liquid-liquid cyclone.

5. The apparatus of claim 2 further comprising an oil decant tank.

6. The apparatus of claim 1 wherein said water processing unit further comprises a filter.

7. The apparatus of claim 6 wherein said filter comprises a self-flushing filter.

8. The apparatus of claim 1 further comprising one or more rotating high-pressure nozzles.

9. The apparatus of claim 1 wherein said solid-liquid cyclone comprises a plurality of solid-liquid cyclones.

10. The apparatus of claim 9 wherein an output of one solid-liquid cyclone is connected to an input of another solid-liquid cyclone.

11. The apparatus of claim 1 further comprising one or more circulating pumps.

12. The apparatus of claim 1 further comprising one or more power supplies.

13. The apparatus of claim 1 wherein said water processing unit further comprises a skimmer.

14. The apparatus of claim 1 further comprising a cleaning deck.

15. The apparatus of claim 14 wherein said cleaning deck comprises a plurality of high pressure cleaning nozzles.

16. The apparatus of claim 14 wherein the inlet of the vacuum system is disposed in said cleaning deck.

17. The apparatus of claim 14 wherein said cleaning deck is disposed at a front portion of said mobile cleaning apparatus.

18. The apparatus of claim 14 wherein the cleaning deck is tiltable.

19. The apparatus of claim 1 further comprising a cleaning deck.

20. The apparatus of claim 19 wherein the cleaning deck is tiltable.

21. The apparatus of claim 19 wherein said cleaning deck comprises a plurality of high pressure cleaning nozzles.

22. The apparatus of claim 21 wherein the inlet of the vacuum system is disposed in said cleaning deck.

23. The apparatus of claim 22 wherein said cleaning deck is disposed at a front portion of said mobile cleaning apparatus.

24. A mobile cleaning apparatus for cleaning large surface areas comprising:

one or more wheels;

a clean water supply tank;

a high pressure pump;

a vacuum system comprising an inlet, said vacuum system disposed wholly above a surface to be cleaned; and a water processing unit comprising:

a liquid-liquid cyclone; and a solid-liquid cyclone, an output of said solid-liquid cyclone connected to a solids waste pot.

25. The apparatus of claim 24 wherein said water processing unit further comprises a filter.

26. The apparatus of claim 24 further comprising one or more circulating pumps.

27. The apparatus of claim 24 wherein said water processing unit further comprises a skimmer.

28. A method for cleaning large surface areas comprising the steps of:

generating a pressurized flow of water;

emitting a spray of pressurized water from one or more rotatably attached nozzles;

creating a flow of air around an area of the surface to be cleaned with a vacuum system having a suction inlet such that at least a substantial amount of the soiled water resulting from the cleaning process is recovered, the vacuum system disposed wholly above the surface;

separating solid constituents of the soiled water from liquid constituents of the soiled water with a solid-liquid cyclone;

collecting the solid constituents of the soiled water in a solids waste pot;

capturing the liquid constituents of the soiled water from the solid-liquid cyclone; and recycling the liquid constituents of the soiled water such that they are pressurized.

29. The method of claim 28 further comprising the step of passing the soiled water through a liquid-liquid cyclone.

30. The method of claim 28 further comprising the step of passing the liquid constituents of the solid-liquid cyclone through a liquid-liquid cyclone.

31. The method of claim 28 further comprising the step of passing the liquid constituents of the soiled water through a filter.

32. The method of claim 31 further comprising the step of passing the liquid constituents of the soiled water through a self-flushing filter.

33. The method of claim 28 further comprising skimming a surface of the soiled water.

34. The method of claim 28 wherein creating a flow of air around an area of the surface comprises creating a flow of air around an area of the surface by sucking air into an inlet disposed within a cleaning deck.

35. The method of claim 34 wherein sucking air into an inlet disposed within a cleaning deck comprises sucking air into an inlet disposed within a cleaning deck mounted at a front portion of a mobile cleaning apparatus.

* * * * *